United States Patent [19]

Groetschel

[11] 4,099,785

[45] Jul. 11, 1978

[54] METHOD AND APPARATUS FOR SUPPORTING THE ROOF OF AN UNDERGROUND MINE WORKING

[76] Inventor: Karl Maria Groetschel, Jakob-Klar-Strasse 5, 80 Munich 40, Fed. Rep. of Germany

[21] Appl. No.: 693,114

[22] Filed: Jun. 4, 1976

[30] Foreign Application Priority Data

Jun. 11, 1975 [DE] Fed. Rep. of Germany ..... 2525978
May 3, 1976 [DE] Fed. Rep. of Germany ..... 2679509

[51] Int. Cl.[2] ..... E21D 19/00

[52] U.S. Cl. ..... 299/11; 61/45 C; 299/12; 299/31; 299/33

[58] Field of Search ..... 61/45 C, 45 D; 299/11, 299/32, 31, 43, 12

[56] References Cited

U.S. PATENT DOCUMENTS 3,399,927 9/1968 Groetschel ..... 299/11

FOREIGN PATENT DOCUMENTS 2,257,830 6/1974 Fed. Rep. of Germany ..... 61/45 D
1,414,256 11/1975 United Kingdom ..... 61/45 D

*Primary Examiner*—Ernest R. Purser
*Assistant Examiner*—William F. Pate, III
*Attorney, Agent, or Firm*—Spencer & Kaye

[57] ABSTRACT

The roof of an underground mine working which is newly exposed by a mining machine passing along a face of the working is supported by applying a flexible mat to the roof and underpinning the mat by self-advancing roof supports. A supply of mat is stored in a region which is already supported by the roof supports, is fed from the store in a first direction, and turned through a right-angle to extend along the newly exposed face. The device which turns the mat and applies it to the roof may have its vertical position controlled in accordance with the vertical position of a cutting cylinder of the mining machine.

12 Claims, 16 Drawing Figures

FIG. 6
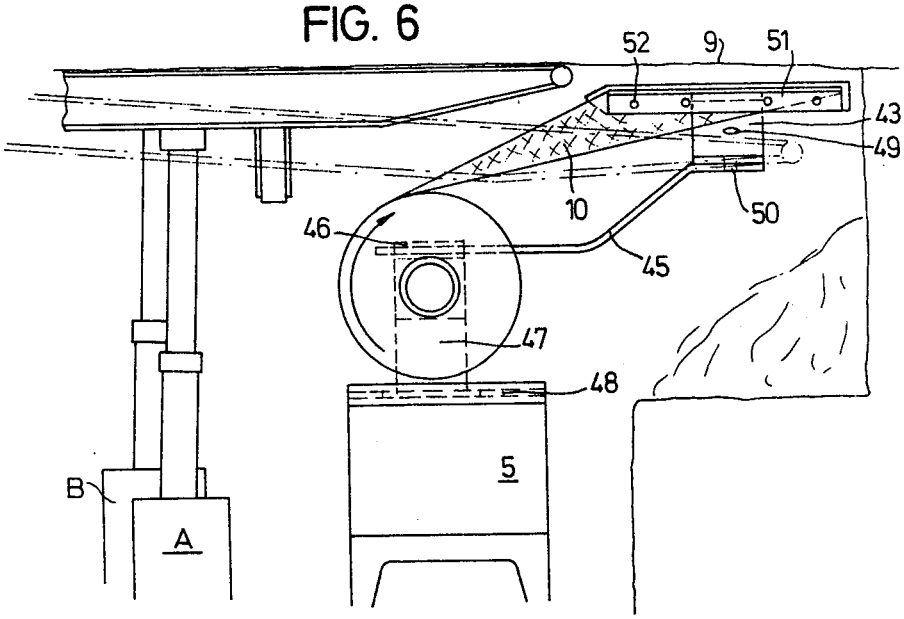
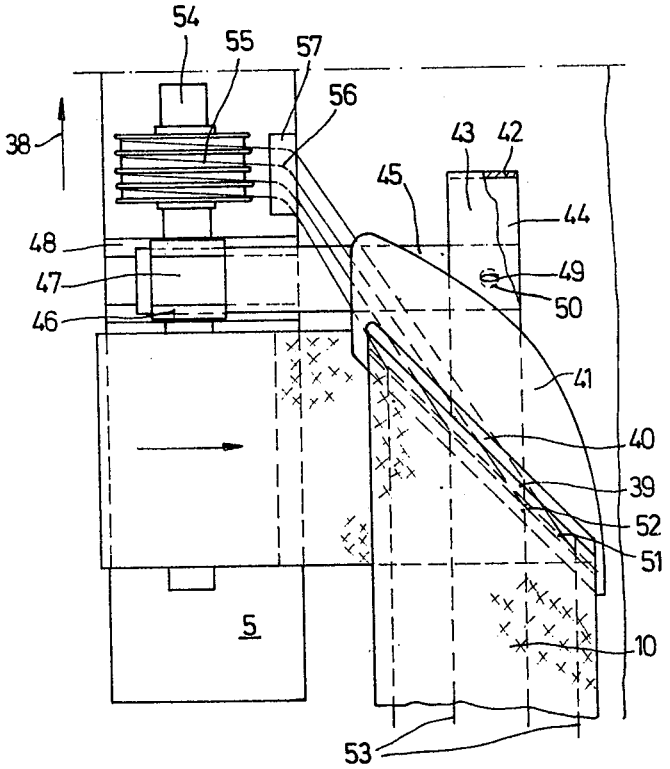
FIG. 7

METHOD AND APPARATUS FOR SUPPORTING THE ROOF OF AN UNDERGROUND MINE WORKING

This invention relates to a method of and apparatus for supporting the roof of an underground mine working in a region newly exposed by the passage of a mining machine along an upright face of the working, in which a flexible mat is applied to the newly exposed roof and held in contact therewith by advancing and loading elements of a self-advancing roof support system. The invention has been developed primarily in relation to the support of the roof of an underground coal mine working in which coal is mined by the method of long-wall coal mining, and the mining machine is a coal-winning machine.

A major problem in certain mine workings is that the strata of the working may be such that the roof is brittle and tends to crumble into small pieces. In addition to the danger that falls of roof material could occur before roof supports can be brought into engagement with newly exposed roof, the installation of roof supports at intervals along the roof may not be sufficient to prevent falls of material between such supports, with consequent risk of damage to machinery and injury to personel working in the region.

It has been proposed to provide support for the roof under such conditions by applying a flexible mat thereto, the mat being held in contact with the roof by the use of spaced roof supports. The operation of applying such mat can be performed automatically if a self-advancing roof support system is in use in the working, a supply of mat following the coal-winning machine and being fed from such supply to the roof and being held in contact with the roof by advancement of the roof support system. However, such methods have involved the storage of the supply of matting, for example in the form of a roll, on a jib or arm secured to the coal-winning machine, in the region beneath the newly exposed roof, which places a limitation on the quantity of mat which can be stored by reason of the available space being limited. Further, the supply of mat is vulnerable to falls of roof material coming from the roof before it has been secured by the support system, and renewal of the mat supply is rendered difficult because of the confined space available for such task.

When mining coal by the long-wall method, if the quantity of mat which can be stored is limited there may not be a sufficient supply to cover a complete traverse of the coal-winning machine along the length of the coal face. This situation is aggravated if further reinforcement is required to be applied to the roof, for example if the mat is to be applied in a double layer. These circumstances would necessitate the provision of an intermediate mat-loading station, which in practice is extremely difficult to accommodate and presents great danger since it involves working in a substantially unsupported roof region.

The object of the present invention is to provide a method and apparatus of supporting the roof of a mine-working, in which these disadvantages are overcome or reduced.

According to one aspect of the present invention, I provide a method of supporting the roof of an underground mine-working in a region newly exposed by the passage of a mining machine along an upright face of the working, comprising storing a supply of flexible mat, drawing mat from said stored supply in a first direction, re-directing said mat to extend along the newly exposed roof, and pressing said extended mat into contact with the roof by advancing and loading self-advancing roof supports in a direction generally transversely of the direction of passage of the mining machine, the stored supply of mat occupying a region which is already supported by the self-advancing roof supports.

The first direction may be generally parallel to the direction of advancement of the self-advancing roof supports, the material being re-directed through substantially a right angle to extend along the newly exposed area of roof.

According to another aspect of the invention, I provide apparatus for applying a flexible mat to the roof of an underground mine working in a region newly exposed by the passage of a mining machine along an upright face of the working, the roof being supported by self-advancing roof supports, such apparatus comprising mobile means for storing a supply of mat, means for leading off mat from said supply in a first direction, and directing means for re-directing said mat to extend along the newly exposed roof, the means for storing the supply of mat occupying a region which, in use, is remote from the newly exposed roof region.

By this means the supply of mat, including the part between the supply and the directing means, is removed from the potential danger of damage arising from fresh roof material falls. Further, accumulation of material in the newly exposed region cannot interfere with the supply of mat and operation of the device.

When the apparatus is to be used in a mine-working, for example a coal seam, of relatively great thickness, the storage means may be mounted on the mining machine itself, thereby eliminating the need for a separate drive for the mat-laying apparatus. Alternatively, the storage means may be mounted on a separate transporter or carrier structure, which may be adapted to be fitted on a conveyor extending generally parallel to the direction of movement of the mining machine.

Such a carrier structure could be adapted to be operatively connected to the mining machine, in order to eliminate the need for providing a separate drive for it. Such a connection could be provided by a chain, rope, draw-bar, or the like.

Alternatively, the carrier structure could be provided with its own drive. For example, this could consist of a cable extending parallel to the direction of working of the mining machine, (i.e. parallel to the coal face) and passing over pulleys at each end of the working, the carrier structure being connected to such cable. The cable itself would be driven by any appropriate means.

The means for storing the supply of mat may comprise a supporting bar or axle, extending generally parallel to the coal face, and adapted to receive matting in the form of one or more rolls thereof.

In view of the available space parallel to the coal face, such orientation of the supporting bar allows it to be equal in length to a multiple of the width of one roll of matting, so that it is capable of accommodating further matting rolls in addition to that which is for the time being actually supplying matting. It is thus possible to supply an adequate quantity of matting for an entire coal face, for a single loading of the supporting bar. When one roll of matting has been consumed, the next adjacent roll merely has to be moved into the place of the first roll and its leading end connected to the rear end of the first roll. Such connection is made in a region which is supported by the roof-engaging bars of the self-advancing roof supports, and thus operators performing such a task are not exposed to danger. For coal seams of relatively great height, e.g. upwards of 2 meters, a comparatively long supporting bar can allow approximately 400 meters of matting to be carried which means that for a coal face of average length a single loading operation would suffice for every pair of traverses of the mining machine.

The supporting bar may be supported cantilever-wise from a suitable upright support, or may be supported in its central region with its free ends projecting in opposite directions to allow rolls of matting to be loaded from opposite sides.

Preferably, however, the free end or ends of the supporting bar are additionally supported by a removable supporting element or elements, such supporting elements when in position serving to prevent rolls of matting from accidentally falling off the supporting bar.

The apparatus may be provided with two directing means operable respectively to re-direct matting from the supply in opposite directions respectively for application to the roof when the mining machine is moving in opposite directions. The or each directing means may comprise a directing or steering member, disposed at the end of a jib member which projects, in use, towards the coal face. Preferably such jib is vertically adjustable and/or vertically resilient, and in the latter case there is preferably provided means for adjusting the pre-loading force by which the jib is biased upwardly towards the roof.

In its simplest form, such jib may take the form of a leaf-spring.

The steering member may be mounted directly on the end of the jib, but is preferably connected to a relatively short arm which is connected to the jib at its end and extends at right angles thereto. It may be arranged such that if the downward load applied to the steering member exceeds a predetermined value, the end of such mounting arm carrying the steering member will yield elastically in a downward direction. By such construction, any heavy lumps of roof material breaking away immediately above the steering member will be deflected and cleared by tilting of the mounting arm.

The mounting arm itself conveniently takes the form of a leaf-spring.

The tension of matting supplied from a roll may be adjusted by a suitable tensioning device. For example, this may be done by a pair of pressure rollers engaging the matting strip on both sides and provided with suitable brake means. Alternatively, a single braking element may be applied under pressure to the roll of matting, on one side only of such roll. If the mat-supporting bar or axle is arranged to rotate, tension may be provided by arranging for a brake to be applied to the bar or axle.

The means for storing the supply of matting, and/or the jib, may be mounted on a supporting frame structure for sliding movement at right angles to the direction of movement of the mining machine. This facility can be used to simplify loading of the storage means, and is also useful if faults are required to be repaired.

The steering member preferably comprises a member affording a steering edge which extends substantially bisecting the angle between the first direction of unreeling of the mat and the direction in which the mat is applied to the roof. Preferably such edge is rounded. Alternatively, direction-changing rollers may be provided.

The directing means may also be provided with means for directing reinforcing wires or the like, if these are required to be used to provide additional support, from a supply thereof to be stretched beneath the matting.

If the apparatus is intended to be used in a working of which the thickness of the seam and thus the height of the face varies considerably, higher demands on the apparatus must be satisfied. Even greater difficulties have to be overcome in workings in which roof falls are liable to occur in the region between the mining machine and that in which the mat has been applied to the roof. It is a further object of the invention to provide a method and apparatus which is more suited to such severe conditions.

According to a further aspect of the invention, there is provided a method of supporting the roof of an underground mine working in a region newly exposed by the passage of a mining machine along an upright face of the working, comprising storing a supply of flexible mat, leading off mat from said stored supply, applying the mat to the roof by directing means so that the mat extends along the newly exposed roof, and controlling the vertical disposition of the directing means in accordance with the vertical disposition of a cutting element of the mining machine.

Since the vertical position of the cutting element, e.g. a cutting cylinder, of the mining machine determines the height of the newly exposed roof, the cutting element can be regarded as continuously probing or scanning the roof to sense its height, and the directing means is then controlled in accordance with the sensed height. When the cutting element is a cutting cylinder rotatable about a generally horizontal axis, the vertical disposition of the directing means would be controlled in accordance with the vertical position of such axis.

According to another aspect of the invention, there is provided apparatus for supporting the roof of an underground mine working in a region newly exposed by the passage of a mining machine along an upright face of the working, comprising mobile means for storing a supply of flexible mat, means for leading off mat from said supply, directing means for directing the mat to extend along the newly exposed region of roof so that it can be underpinned by self-advancing support means, and means establishing an operative connection between said directing means and a cutting element of the mining machine so that the vertical disposition of the directing means is controlled in accordance with the vertical disposition of said cutting element.

The directing means may either bring the strip of matting into contact with the roof, or may position it at a suitable distance relative to the roof. The means for storing the supply of mat may be detachably mounted on the mining machine. Alternatively, the storage means could be combined with the directing means.

The means for establishing the operative connection between the directing means and cutting element may comprise a parallelogram arrangement of pivotally interconnected members, of which a first member is provided by the body of the mining machine, a second member by an arm on which the cutting element is supported, the third member by an arm or lever pivotally mounted on the body of the machine, and the fourth member by a rigid member extending between the free ends of the second and third members. The fourth member may be connected to the first member at a point lying on the axis of rotation of the cutting cylinder.

The directing means may be mounted on a vertically movable part of a telescopic support structure, such vertically movable part being connected, for vertical movement in accordance with the vertical position of the axis of rotation of the cutter cylinder, to the fourth member of the parallelogram or an extension thereof. Thus, the vertically movable part may be provided with guide means slidable on the fourth member or an extension thereof, preferably the latter.

Alternatively or in addition, the vertically movable part may be, or be adapted to be, rigidly connected with the said fourth member so that the directing means follows the movement of the axis of rotation of the cutting cylinder.

In an alternative construction, the means for establishing the operative connection between the directing means and cutting element may utilise ropes or like flexible drive members. Preferably two flexible drive membes are utilised, one being arranged to be moved in accordance with movement of the axis of rotation of the cutting cylinder and the other controlling the movement of the directing means, a pulley or gearing arrangement providing a desired transmission ratio between the first and second drive members.

In an another alternative construction, the means for establishing the connection between the directing means and cutting element may comprise two mutually communicating hydraulic piston cylinder units, arranged so that a raising of the cutting element effects a raising of the directing means.

If the invention is to be applied to a coal mining machine which includes a clearer or scraper plate member associated with the cutting cylinder, there being a mechanism for controlling the position of such plate member in relation to the vertical position of the cutting cylinder, the vertical position of the directing means may be controlled in accordance with movement of the plate member. This may be achieved by detachably securing the mat directing means to the plate member, or by providing a direct connection between the directing means and control mechanism which adjusts the plate member. If the means for storing the supply of mat is mounted with its axis extending parallel to the direction of movement of coal cutting machine, it will be necessary to provide suitable coupling between the roll of matting and the axis of rotation of the cutting cylinder.

The connecting means by which the motion of the cutting element is transmitted to the directing means may be connected to the cutting element by a hook mechanism such that the connecting means can be disconnected by being moved substantially vertically upwardly relative to the cutting element. Thus, the connecting means preferably includes a connecting member which terminates in a downwardly opening hook-like portion, such portion being engageable with a coupling member which, when the cutting element is a cylinder rotatable about a horizontal axis, is mounted on the axis of rotation of the cutting cylinder. The opening of the hook is preferably closed by a releasable locking mechanism, openable automatically to release the coupling member therefrom if the axis of rotation of the cutting cylinder drops below a predetermined minimum level.

For protecting the apparatus against overloading, which could occur, for example, if the vertical position of the cutting element of the mining machine is adjusted rapidly upwardly whereupon the directing means attempts to follow the former but is prevented from doing so by the previously exposed area of roof, there may be provided cut-out means operable to stop the mining machine. In the case in which the directing means is resiliently supported, e.g. by way of leaf spring arrangement, there may be provided an actuating element mounted at a position to be contacted by the directing means (or a part associated therewith) upon the latter being displaced downwardly by a predetermined distance. The actuating element preferably comprises a piston slidable vertically within and projecting from the top of a hydraulic cylinder.

It will be appreciated that any or all of the features of the invention above defined may be combined if appropriate.

The invention will now be described by way of example with reference to the accompanying drawings, of which:

Figure 4:
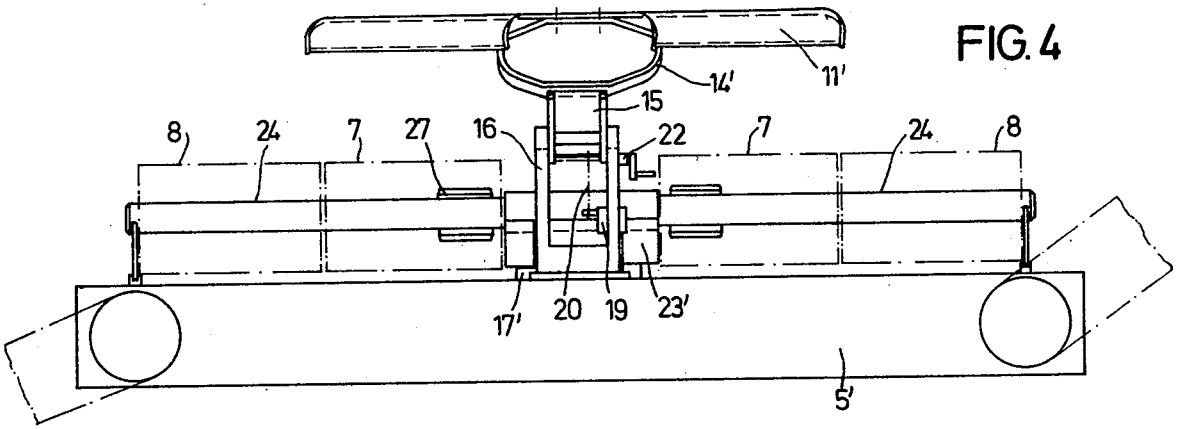
Figure 5:
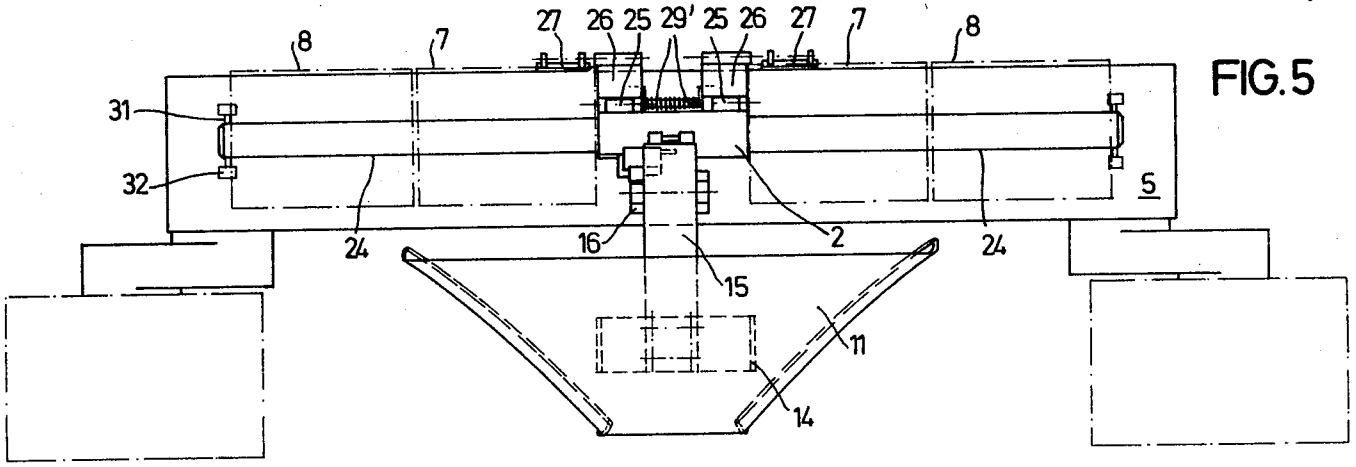
Figure 8:
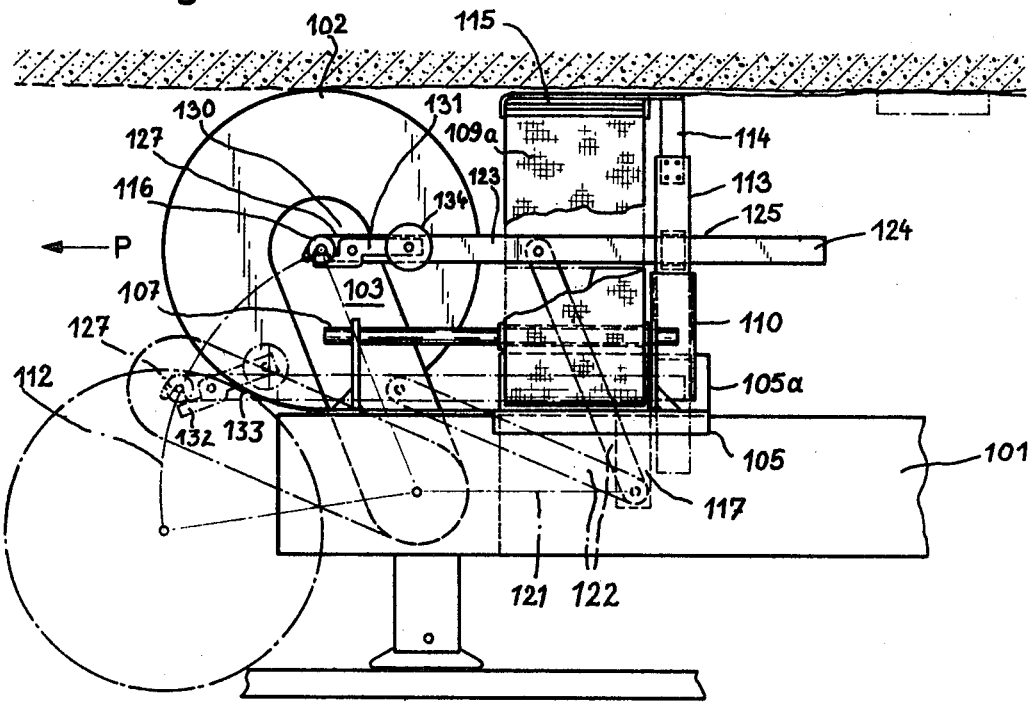
Figure 9:
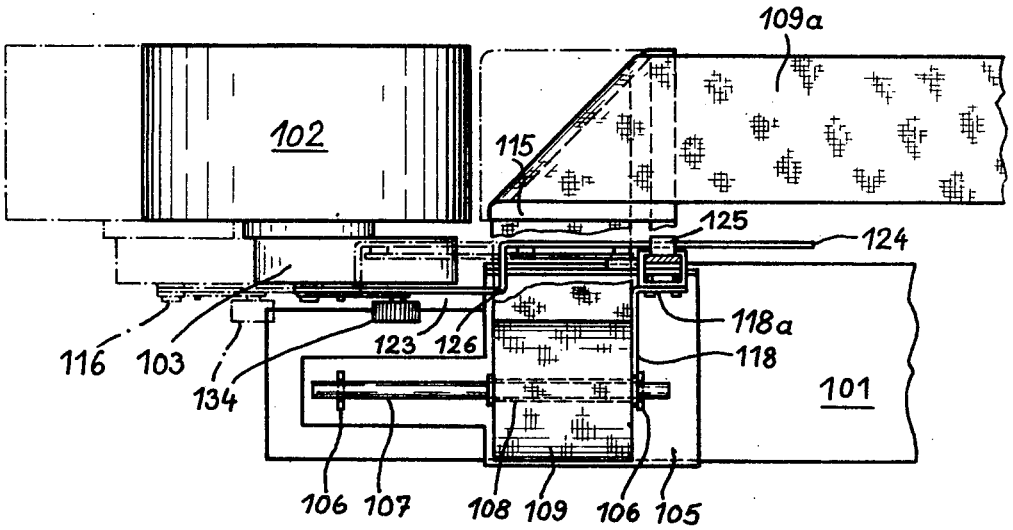

FIG. 4 is a front elevation of a modified form of mat-laying apparatus embodying the invention, FIG. 5 is a plane of the apparatus of FIG. 4, FIG. 6 is a side elevation of yet another embodiment of mat-laying apparatus embodying the invention, FIG. 7 is a plan of the apparatus of FIG. 6, FIG. 8 is a diagrammatic side elevation of apparatus embodying a further aspect of the invention, FIG. 9 is a plan view of the apparatus of FIG. 8

Figure 10:
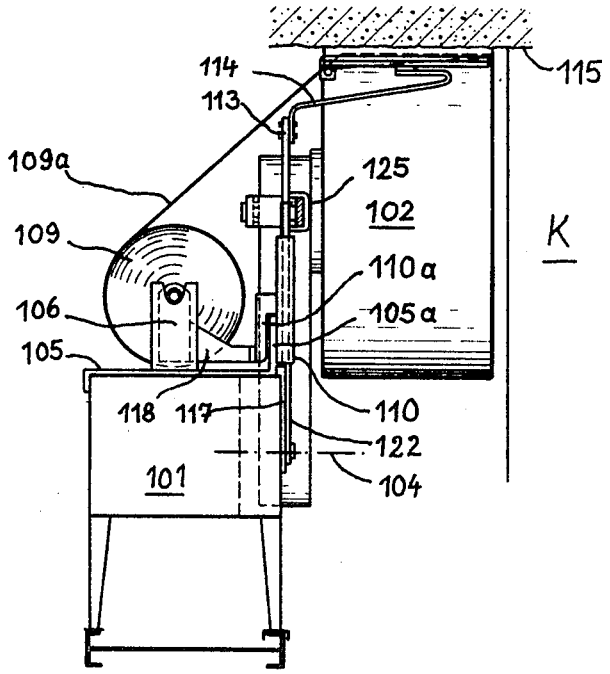
Figure 11:
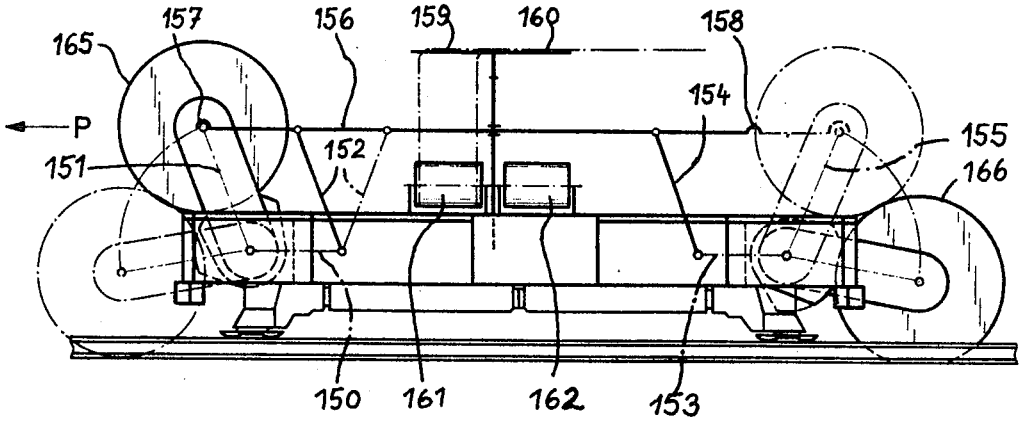
Figure 12:
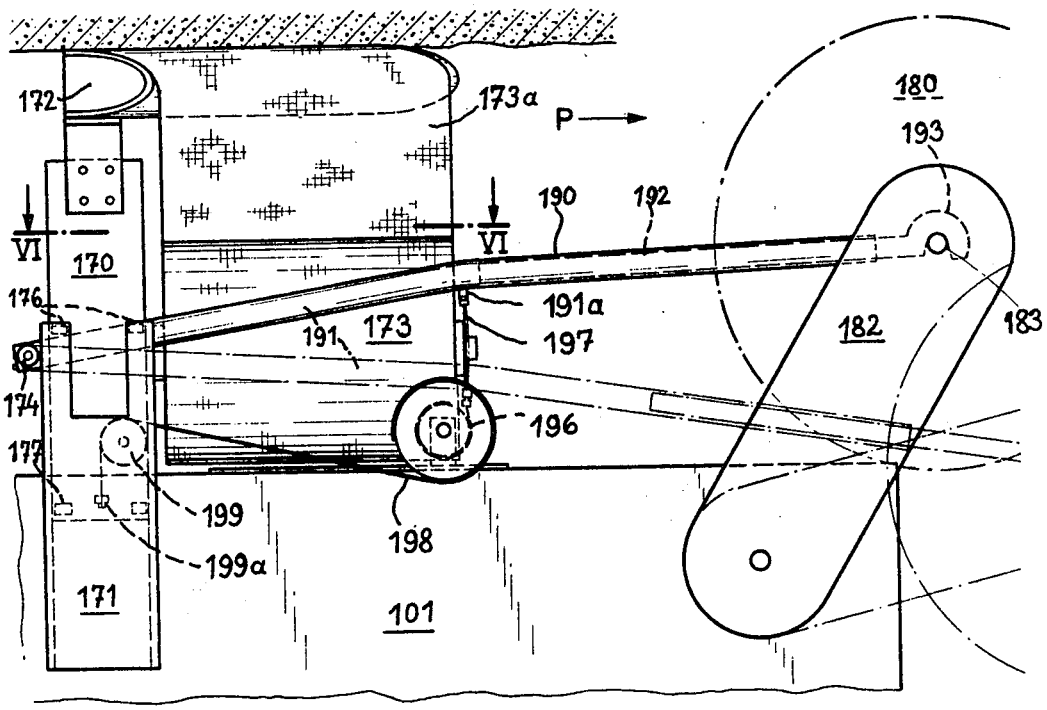
Figure 13:
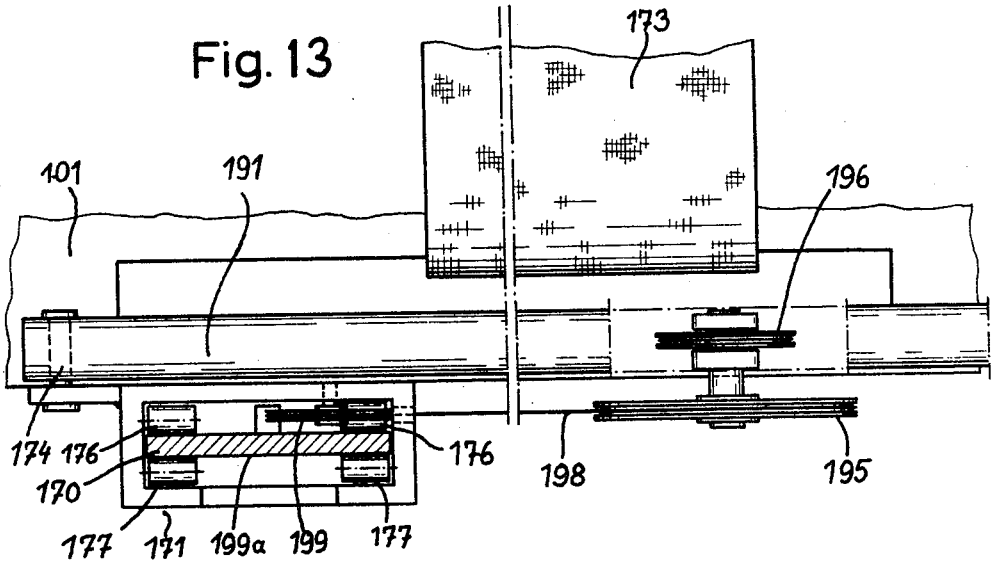
Figure 14:
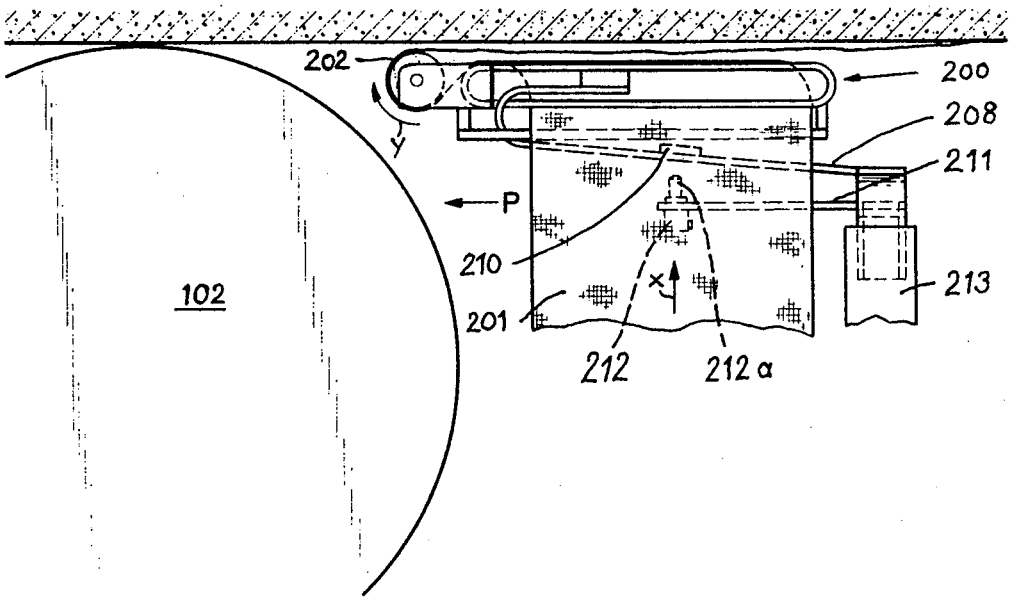
Figure 15:
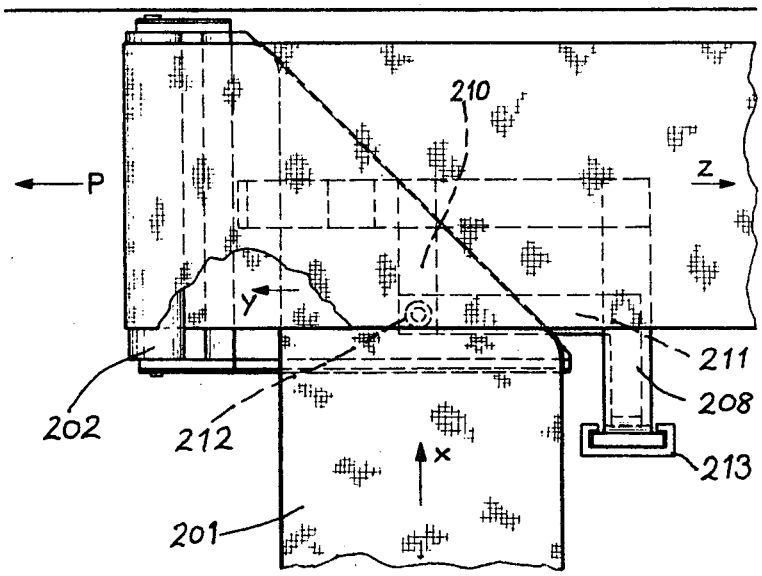

FIG. 10 is a view in the longitudinal direction of the apparatus of FIGS. 8 and 9, together with diagrammatically represented coal cutting machine;

FIG. 11 is a side elevation of a further form of apparatus;

FIGS. 12 and 13 are respectively a side elevation and an enlarged artial view from above along the line 13—13 in FIG. 12 of another embodiment of the invention;

FIG. 14 is a side elevation;

FIG. 15 is a view from above; and

Figure 16:
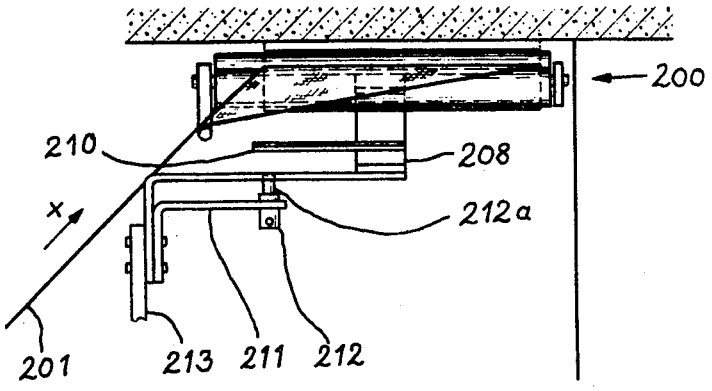

FIG. 16 is a view in the longitudinal direction of the machine of a special form of execution of an elastic mat-applicator device with safety or emergency cut-out device for the drive of the associated coal cutting machine.

Figure 1:
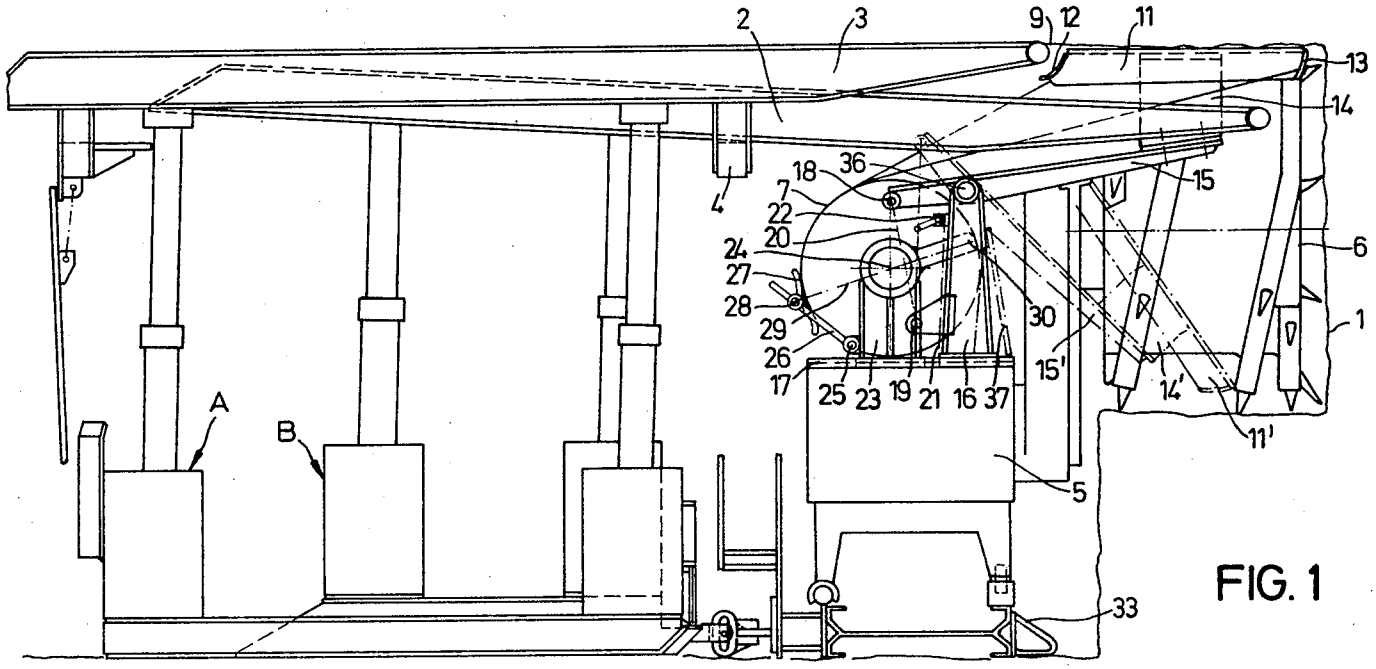
FIG. 1 is a side elevation of a mine working including apparatus embodying the invention.
Figure 2:
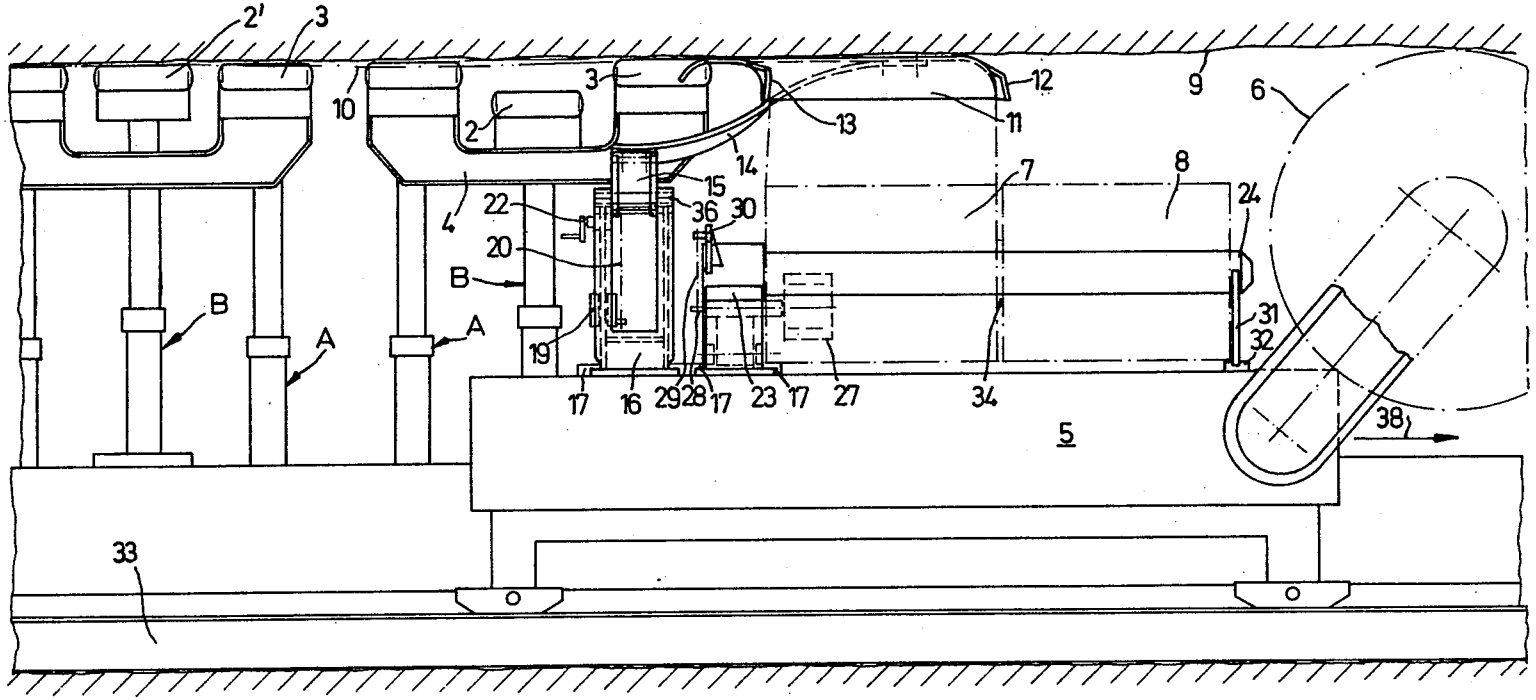
FIG. 2 is a front elevation of the mine working.
Figure 3:
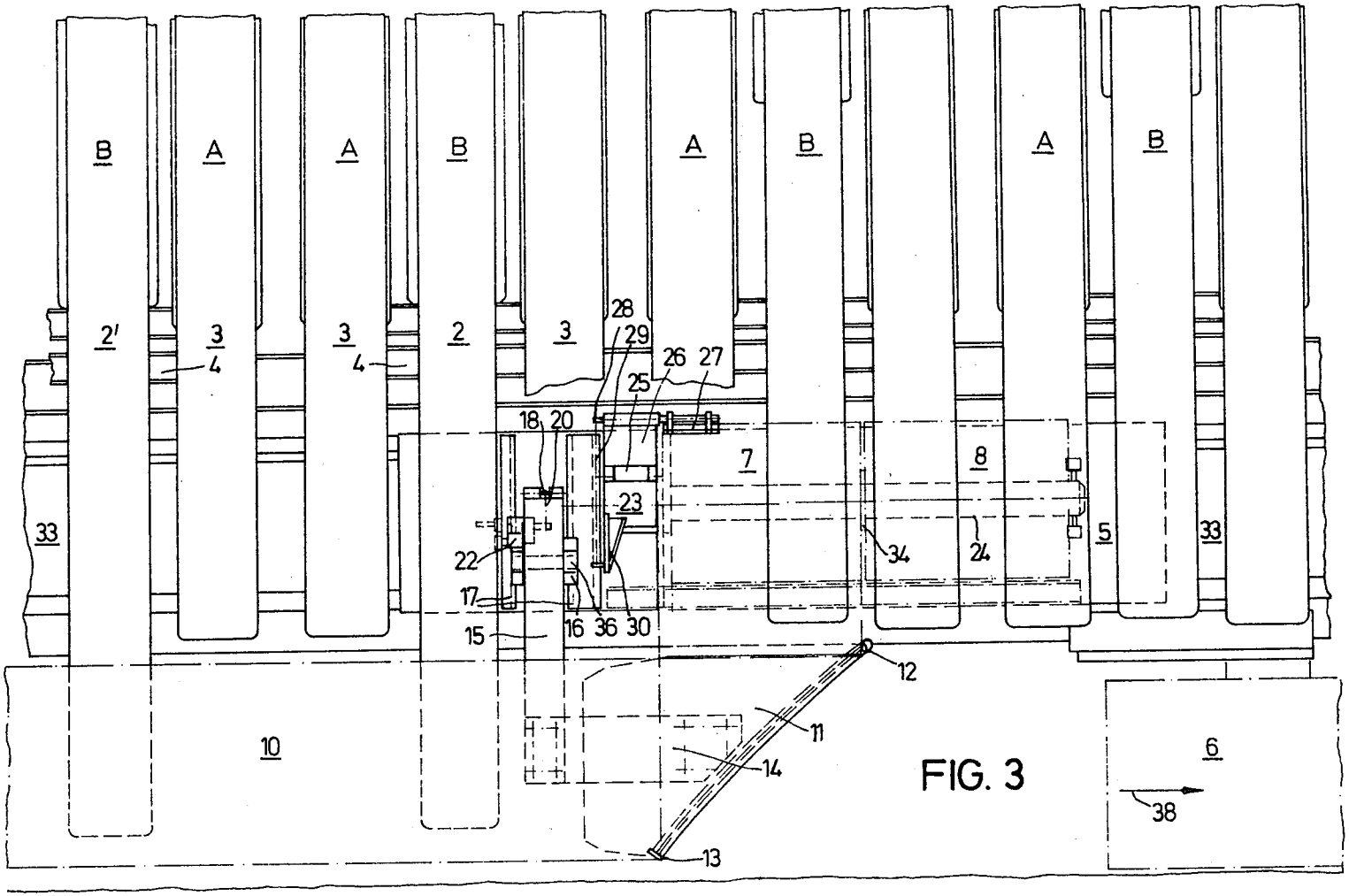
FIG. 3 is a plan of the mine-working.

Referring firstly to FIGS. 1 to 3, there is illustrated part of a coal mine working in which a coal-winning mining machine, indicated generally at 5, is moved longitudinally along an upright coal face 1. The machine illustrated is a scraping machine comprising a scraping cylinder 6 which projects towards the coal face.

The roof of the working is secured by hydraulic two-step self-advancing roof support units. Each of these units comprises an outer frame A having two spaced parts, and an inner frame B slidably guided between the parts of the outer frame A. Each frame comprises hydraulic props disposed between roof and floor-engaging bars, and by alternate loading and relieving of the props which apply the roof bars 3 of the outer frame A, and the roof bar 2 of the inner frame B to the roof, and by actuation of an advancing ram (which operates between the frames A and B but which is not illustrated), these support units can be advanced towards the coal face in a direction generally perpendicular thereto.

The roof bars 3 of the outer frame A are mutually connected by a cranked transverse beam 4, which serves as a bearing for the roof bar 2 of the inner frame B during forward displacement of the latter.

For assisting in the prevention of falls of loose material from the roof, there is provided apparatus for applying flexible matting to the roof. A top or cover plate 5 of the coal-scraper machine is provided with a supporting bar or axle 24 on which are carried rolls 7 and 8 of matting, roll 7 in the present example being in use and roll 8 being a reserve roll. The bar 24 extends parallel to the coal face, i.e. in the direction of travel of the coal-scraper machine.

The apparatus further comprises a jib 15, extending from the region of the stored matting upwardly and forwardly towards the coal face. A mounting arm 14 is attached at right angles to the end of the jib 15 which is nearest the coal face, and a steering member 11, provided with a steering edge which extends at an angle of approximately 45° to the coal face, is mounted at the free end of the mounting arm 14. The mounting arm 14 takes the form of a leaf-spring, and allows an elastic downward movement of the steering member 11.

The jib 15 is pivotally mounted at 36 on a supporting base 16, the point 36 being intermediate the ends of the jib so that the jib takes the form of a two-armed lever. The end of the jib 15 remote from the coal face is engaged at 18 by a spring 20, of which the other end is connected to a vertically adjustable setting member 19 for adjusting the pre-loading of the spring 20. Vertical adjustment of the member 19 is obtained by means of a spindle 21 actuated by a manual crank lever 22, the jib 15 being lowered by sliding adjustment of the member 19 in the upward direction.

In use, matting strip to be applied to the newly exposed roof after the passage of the scraper cylinder 6 is drawn off the matting roll 7 and led over the steering edge of the steering member 11 so that the direction of the strip of matting is changed from perpendicular to parallel to the coal face. The steering member 11 is pre-loaded upwardly by the jib 15, so that the matting strip is applied to the roof and kept there until the self-advancing roof support units have been advanced and the roof bars thereof hold the matting (10, FIGS. 2 and 3) in contact with the roof.

Because of the elasticity afforded by the construction of the mounting arm 14 as a leaf-spring, and by the operation of spring 20 on the jib 15, the steering member 11 can be tilted if it should be subjected to the descent of heavy pieces of roof material, thereby clearing such material automatically.

The supporting base 16 for the jib 15 is slidable on mounting rails 17 at right angles relative to the coal face. The supporting bar 24 for the matting rolls 7 and 8 is mounted on a supporting stand 23, which is similarly slidable.

For supplying a required tension to the strip of matting paid out from the roll 7, there is provided a brake block 27 which is pivotally mounted at 28 on a lever 26 which is in turn pivotally mounted at 25 on supporting stand 23. A brake spring 29 engages with the brake block 27 in the region of the pivot 28, the opposite end of the spring 29 being attached to the free end of a supporting arm 30 provided on the stand 23. The spring 29 thus urges the brake block 27 into engagement with the roll of matting, and the degree of loading of spring 29 determines the engagement force and thus the tension of matting paid out from the roll 7.

The free end of the supporting bar 24 for the matting rolls 7 and 8 is supported by a strut 31 which is adapted to be removed when it is required to place new rolls of matting in position on the bar 24. The strut 31 is fitted in bearing shoes or skids 32 on the frame of the coal-scraping machine, and serves to secure the matting rolls 7 and 8 against accidental slipping off the bar 24.

A spacer disc 34 fitted on bar 24 serves to keep the rolls 7 and 8 spaced apart.

For additional protection against rock falls from the side of the coal face, a packing plate 37 may be additionally provided as shown in FIG. 1. As a rule, however, such a plate 37 will be needed only when working in very tall seams.

The mat-laying apparatus of FIGS. 1 to 3 is associated with a coal-scraper machine 5 which is adapted to work in one direction only, as indicated by the arrow 38. In FIGS. 4 and 5, on the other hand, the mat-holder means have been symmetrically duplicated which makes them adapted for mat laying in both of the possible directions of working of a coal winning machine 5. Accordingly, the steering member 11 which is supported by a single jib 15, comprises two rounded steering edges approximately at right angles to one another and each angled at approximately 45° relative to the respective direction of working of the machine 5. Since in all other respects the apparatus largely corresponds to that which has been described with reference to FIGS. 1 to 3, like parts have been designated by like reference numerals and the preceding description is applicable to this embodiment.

In the embodiment of the invention illustrated in FIGS. 6 and 7 the steering edge of the mat-steering device is provided by the rounded (in section), rectilinear edge 39 of a slit 40, facing the matting strip 10, which slit 40 is formed in a guard plate 41 which in this case constitutes the steering member.

The supporting structure for the steering member, which corresponds to the jib 15 and the arm 14 of the arrangement described in connection with FIGS. 1 and 3, in this case consists of a leaf-spring 42, extending parallel to the coal face and carrying the guard plate 41 on its upper part 43, whilst its lower part 44 is rigidly secured to a leaf-spring 45 which extends transversely of the spring 42. The rear end of the leaf-spring 45, which corresponds to the jib 15, is mounted in a dove-tail guide 46 on a stand 47 which also supports the supporting bar for the matting rolls and which in its turn is mounted in a dove-tail guide 48 on the coal winning machine 5.

The supporting spring construction 42, 43, 44 and 45 imparts a virtually universally effective elastic resilience to the steering member which protects it and the mat against damage in the event of any of the parts hitting against corners or projecting irregularities in the roof or coal face.

The roof-like guard plate 41, which is rounded as illustrated, also facilitates the passage over such obstacles. It should also be mentioned that the guard plate 41 and thus the region of the matting strip which at that moment passes over the steering edge must not always be applied direct to the roof 9 of the working but may be slightly spaced away therefrom as may be observed from FIG. 6.

The dove-tail guides 46 and 48 allow the steering member alone, or the mat-laying device as a whole to be slidingly displaced at right angles relative to the coal face. If such displacement should also demand lowering of the steering device this can be obtained by fitting a tensioning element, not here shown, in one of the bores 49, 50 which are provided in the leaf-spring parts 43, 44, 45, said tensioning element being secured on the other side, for example to the stand 47 or the subframe of the coal-winning machine.

The guard plate 41 is provided on its underside with a downwardly projecting web 51, for example provided by an angle section and fitted with suitably spaced apart holes 52. Through these holes 52 are passed reinforcing wires or cables 53 (FIG. 7) beneath the matting strip, which are automatically reeled off during travel of the coal-winning machine 5 in the working direction from a storage reel 55 fitted on the supporting bar 54.

These reinforcing wires or cables 53 are guided or steered from the direction of unwinding off the reel 55 towards the holes 52 in the web or bar 51 by means of steering or direction-changing edges 56 provided on a stand 57 fitted on the machine 5.

Over and above the hereinbefore described examples of execution there are a number of further modifications and developments of the mat-laying device according to this invention which may be applied within the general framework of the inventive principle. For example, for strengthening a mat by means of a second mat stretched therebeneath, which may be necessary in certain cases, said second mat may be drawn off from a second supply and advanced into the correct position by means of a second steering member arranged beneath the previously layed first mat. Alternatively it is possible to lay two strips of matting, which have been coiled up on a common roll to form a double layer mat, with the aid of one of the mat laying devices hereinbefore described and illustrated.

Further, it is not absolutely essential that the mat laying device should be mounted on the coal-winning machine, although this arrangement lends itself as the simplest solution for seams of major thickness. In shallower seams the device may also be mounted on a separate transporting frame which is either operatively connected by traction means with the coal cutting machine and thus follows the latter, or which may be provided with its own separate drive.

In the embodiment shown in FIGS. 8, 9, and 10 of the drawings, the body of a coal cutting machine is designated at 1. The machine comprises a cutter cylinder 2 which is shown in its operative position mounted on an arm 103 which is pivotable about an axis 104.

With the cutting machine is associated apparatus for applying mat to the newly applied roof as the cutter machine travels along the coal face, such apparatus basically comprising two main units, namely a holder unit which carries a store of matting and is fitted on the body of the cutting machine 111, and a mat-directing or applying device which is automatically vertically adjustable in direct proportional relation with, and to the same degree as, the vertical position of the axis of rotation of the coal cutting cylinder 102. The holder unit includes a support or base plate 105 securely fitted on the machine body 111, and shaft or axle 107 carried on uprights 106 and extending parallel with the coal face (K). A roll of matting 109 on a core tube 108 is received on the shaft 107. Matting is continuously unwound in a strip 109*a* from the storage roll 109, and is applied to the roof by a directing device 115. An upstanding telescopic support or leg carries device 115, and comprises an outer part 110 which is fitted by means of a hook-shaped extension 110*a* on a slide rail 115*a* formed on the support or base plate 105 and releasably secured thereon by means of bolts, screws or like securing elements not shown in the drawing. A slidable part 113 of the telescopic leg is guided within the outer part 110 and has device 115 connected therewith by a system of leaf springs 114. The parts 113,114 and 115 and likewise the cutter cylinder 102 are shown in their highest position in continuous lines in FIG. 1, this being approximately the topmost position to which the cutter cylinder may be pivoted in the upward direction. Dot-and-dash lines on the other hand, indicate the same parts in approximately the lowest position to which the device can be dropped (in the practical case corresponding to the illustrated example this would be about 80 cm lower than the topmost position).

During vertical adjustment, the axis of rotation of the cutter cylinder 102 describes a circular arc 112 about the pivot axis 104 of the arm 103, which means that such height adjustment involves a horizontal component as well as a vertical one. The vertically adjustable mat-directing device 113,114,115, on the other hand, is required to follow the movement of the cylinder axis in the vertical plane only and this without any significant deviation from directly proportional relation with the vertical component of the arcuate motion of the axis of rotation of the cutter cylinder.

In the embodiment of the invention illustrated in FIGS. 8, 9 and 10, this is achieved by means of a coupling device in the form of a parallelogram of levers (parallel-crank drive) engaging with a coupling member 116 provided on the cylinder arm 103, in alignment with the cylinder axis.

The levers of this parallelogram are provided by a portion 121 of the machine body 101 (indicated in mixed lines in FIG. 1) or a component part connected therewith, the pivot arm 103 of the cutting cylinder, a rod 122 linked to a downwardly directed extension 117 of the base plate 105 or to the machine body 101 itself, and a further rod 123 connected at one end with the cutter cylinder by means of the coupling member 116 on the pivot arm 103 which is aligned with the cylinder axis, and in the region of its other end with the rod 122. In the illustrated example the rod 123, which is substantially parallel with the longitudinal axis of the machine body 101 is provided with a rearward extension 124 which passes through a sliding sleeve 125 fitted on the slidable part 113 of the telescopic leg. By virtue of this sleeve the arm 123,124 becomes a support for the mat-directing device 113,114,115. Thus, the linage arm 123,124 which co-acts with the sliding sleeve 125 determines the height of the mat-directing device in directly proportional relation with the vertical position of the axis of rotation of the cutter cylinder 102.

Since the slidable part 113 is guided within the outer part 110 of the telescopoc leg with freedom of movement in one direction (vertical) only, it follows that only vertical position changes of the axis of rotation of the cutter cylinder 102 will be transmitted to the mat-directing device 113,114,115 whilst the horizontal component of the circular movement described by this axis of rotation is not transmitted thanks to the sliding engagement of the rod 123, 124 in the sleeve 125 of the part 113. In consequence of the sliding movement between the supporting rod 123,124 and the sliding sleeve 125, all parts of the directing device 113,114,115 will participate directly proportionally only in the vertical movement of the rod 123,124 coupled with the axis of rotation of the cutter cylinder 102.

In the embodiment shown in FIGS. 8, 9 and 10 some parts of the mat-directing device 113,114,115 extend beyond the edge of the machine body 101 to allow maximum height adjustability of the device. Consequently the rod 123,124 is cranked at 126 so that it is aligned, at one end, with the sleeve 125, and at the other end with the coupling member 116. With such a constructional arrangement the slidable part 113 may be lowered below the surface level of the machine body 101. The crank may be dispensed with, however, if, in view of less stringent demands with regard to height adjustability the telescopic leg 101, 113 may be situated further towards the centre of the machine.

In the illustrated example of execution the rod 123, 124 is of hook-like configuration at the point where it engages with the coupling member 116. If the cutter cylinder is lowered below the minimum height for the mat-directing device, which height is determined when the rod 123,124 abuts against the body of the machine or against a specially provided stop, the coupling member 116 which cotinues to descend would become disengaged from a slit-like opening in the hook (127) which latter remains in position without exposing the coupling member 116 itself or any other parts of the mat applicator device to risk of damage.

In the illustrated example of execution a locking mechanism is provided to close the downwardly open slit or slot in the hook 127 which mechanism, on the one hand, prevents unintentional disengagement betwen the hook 127 and the member 116 engaging therein, and on the other hand automatically releases the slit or slot as soon as the device has reached its minimum height. The locking mechanism is simplified form as shown in FIG. 1, comprises a two-armed lever 131 pivotally mounted on the rod 123 at 130, of which lever the shorter arm 132 extends as a locking member over the slit or slot in the coupling hook and the opposite arm 133, which is preferably several times longer than the arm 132, is engaged by a loading force applied by an adjustable and/or exchangeable weight 134, (or by a spring, a hydraulic cylinder or like means) which tends to keep the locking arm in front of the slit in the coupling hook 127. As soon as the coupling hook 127 has reached its lowest level the coupling member 116 which continues to follow the curved path described by the axis of rotation of the cutter cylinder 102 will force the locking arm 132 out of its locking position relative to the hook slot, thus automatically disengaging the mat-directing device from the cutter cylinder, as is necessary at this particular point.

As shown in dot-and-dash lines in FIG. 1, the unit consisting of the parts 114 and 115 of the mat-directing device is separately vertically adjustable on the part 110. This may be of special advantage, for example when a new matting strip is fitted whilst the arm 123,124 of the parallelogram of levers has not, been lowered, or if it is necessary to repair malfunctions in the coupling device.

Under certain circumstances, for example when working with coal cutting machines wherein the cutter cylinders have a very large pivotal radius and correspondingly large range of movement for the cylinder axes in the horizontal direction, it may be desirable, when operating in workings with sensitive roof layers, that the mat-directing device should follow the relative horizontal movements of the cutter cylinder at a constant distance. In the example shown in FIGS. 1, 2 and 3 this is possible by dynamically coupling the whole of the mat-laying device with the operative top cylinder of the coal-cutting machine 101.

It is possible to arrange for the mat-laying device, including the matting roll 109, to follow the horizontal component of movement of the axis of roration of the cutter cylinder 102 by connecting the rod 123,124, in the region of the sleeve 125, non-slidably with the part 113 of the telescopic leg. The other part 110 of the leg is released from the stationary base plate 105 by slackening or disengaging its locking element and (detachably) connecting the outer part 110 of the telescopic leg with an extension or projection 118 arranged on the core tube 108 of the matting roll 109, by means of an arm **118*a* fixed to a hook portion 110*a* of the outer leg part 110. Appropriate clearance for sliding displacement of the matting roll 109 is created by making the supporting shaft 117** of the matting roll of appropriate length.

For coal cutting machines with double cutter cylinders, capable of cutting while travelling in both directions along the coal face, it is possible to use the apparatus which is diagrammatically represented in FIG. 11, which is particularly easy to switch over from one roll or cylinder to the other and constructed similarly to that shown in FIGS. 8 to 10. In the example of execution shown in FIG. 11 each of the two cutter rolls or cylinders is associated with a parallelogram of levers, each comprising an arm 150,151,152 or 153,154 and 155 respectively, and a coupling or connecting rod 156 extending parallel with the machine body and in each case providing the fourth lever arm. Each end of the coupling rod 56 has a coupling hook 157,158 respectively formed at its end in the manner described with reference to FIG. 8. The mat-directing device which is controlled or steered by the common coupling rod 56 is arranged medially between the two cutter cylinders on the machine body. However, its construction corresponds to that of the example shown in FIGS. 8 to 11, with the exception of a two-part directing device being provided whereof the left hand part 159 which is operative on the outward travel of the machine (arrow P) as shown in the drawings draws the matting strip to be laid from a storage roll 161 whilst its right hand part 160 receives the strip of matting from a roll 162.

In the illustration of FIG. 11 the mat-directing device is coupled via the coupling rod 156 with the cutter roll or cylinder 165 which is the upper cylinder of the machine while the right hand part of the coupling rod 156 is disnegaged from the associated lower cutter cylinder 166. The right hand part of the coupling rod 156, which is provided with coupling hook 158 is hooked into the axis of rotation of the right hand cutter cylinder when this cylinder 166 adopts the function of the upper cutter cylinder during the return journey of the machine.

In order to allow the pivot arms of the two lever parallelograms to be unimpededly pivoted (mechanically or manually) in the upward direction into the new operative position the mat-directing part which is carried by the coupling rod 156 is lowered by the necessary amount relative to the coupling rod. This may be achieved by mounting the directing part in question for separate vertical adjustment on its telescopic supporting leg 110, 113, similarly to the part 114,115 shown in FIGS. 1 to 3.

In principle the mat-laying device according to FIG. 11, similarly to the device shown in FIGS. 8, 9 and 110 may be combined as a unit with the matting rolls and thus be adapted to follow synchronously also the horizontal movements of the operative cutter cylinder.

If, in view of particularly sensitive roof conditions the distance between the mat laying device and the operative upper cutter cylinder must be kept particularly short it is also possible, instead of the two-directionally operative unit according to FIG. 11, to provide, for example, two separate and completely independent mat-laying devices on the machine each of which might then correspond to the example shown in FIGS. 8 to 10.

In the embodiment depicted in FIGS. 12 and 13 a coupling device which controls the vertical position of a mat applicator 172, for matting strip 173*a* taken from the matting roll 173, which applicator is supported on a slidable part 170 of the telescopic support leg 170,171, in directly proportional relation with the vertical adjustment of the axis of rotation of a cutter cylinder 180, comprises a telescopic bar 190. The outer element (191) of this telescopic bar is fitted at 174 on an extension of the outer telescopic leg element 171, which is fixed on a plate detachably mounted on the machine body 101. The inner part (192) of the telescopic bar 190 is formed with a hooked end 193 whereby the part 192 can be engaged with a coupling bolt 183 on a pivot arm 182 which supports the cylinder, the bolt being aligned with the axis of rotation of the cutter cylinder 180.

The coupling device further comprises a transmission untilising ropes or like flexible drive members, and comprising two winding pulleys 195,196 secured on a common axis of rotation and of relatively different diameters. One rope 197 has one of its ends secured at 191*a* to the outer part 191 of the telescopic coupling bar which is connected with the part 181, whilst the outer end is secured to, and wound up on the smaller diameter pulley 196. A second rope 198 is secured to the larger pulley 195 and would up in such a way that its looping angle will proportionally decrease during the winding up of the first rope 197. The free end of the second rope 198 is passed over a direction-changing pulley 199 mounted on the part 171 and connected by means of a coupling bolt 199*a* to the vertically slidable part 170 of the mat-applicator device.

The effective lengths of the ropes or cables 197 and 198, which are kept taut by the weight of the parts 170,171 of the mat-applicator device, are co-oerdinated or relatively adjusted by means of the pulleys 195 and 196 which, in the illustrated arrangement, work as a reduction gearing or transmission ratio changing device with regard to the ratio between the vertical component of movement of the axis of rotation of the cylinder, which describes a large circular arc and the distance covered by the connecting point 191*a* of the rope 197 to the bar 190 (which describes a substantially smaller arc virtually coincinding with a perpendicular chord) in such a way as to achieve a directly proportional dependence of the height variation for the mat-applicator device in relation to that of the cutter cylinder 180. The degree of accuracy for such a dynamic coupling will be the greater, the smaller the difference can be selected between the length of this (smaller) arc and the respective chord.

An additional co-ordination can be achieved if the articulation point 174 for the telescopic bar 190 is made adjustable in the pivotal plane. Correspondingly, the connecting point 191*a* for the rope on the telescopic bar 190 and the connecting point for the rope 197 on the plate 195 may be adjustable likewise.

The necessity for providing a ratio transmission device for the cable drive in the illustrated example of execution arises from the circumstances that as a general rule, for construction reasons it is impossible to select the pivot radius of the connecting point 191*a* for the cable 197 on the telescopic bar 191 equal to that of the cutter cylinder.

If it is desired that the mat-applicator device shown in FIGS. 12 and 13 together with the matting roll 173 should also follow the movements of the axis of rotation of the cutter cylinder 180 in the horizontal direction, the two parts 191 and 192 of the telescopic bar 190 are relatively immobilised with the result that the bar is also capable of transmitting longitudinal forces. In this arrangement the coupling hook of the coupling device may also be secured agains unintentional disengagement by means of an automatically disengaging locking mechanism of the kind described in connection with FIG. 8, or similar.

For improved and easier guidance of the telescopic supporting leg for the mat applicator device there are provided upper and lower pairs of rollers 176 and 177 between the relatively slidable parts 170,171 of the supporting leg (FIGS. 5 and 6) whereof the upper rollers 176 are mounted on the guide member 171 whilst the lower rollers 177 are mounted on the slidably guided member 170.

Instead of the rope or cable transmision shown in FIGS. 12 and 13 the dynamic coupling between the telescopic bar 190 and the mat applicator device may be realised with the aid of a pair of mutually communicating hydraulic cylinders. These cylinders must be arranged in such a way that one volume or chamber of the hydraulic cylinder which is associated with the telescopic bar 190 will drain into a chamber or volume of the other hydaulic cylinder which determines the vertical position or height of the mat-applicator device. For preference, however, the cylinders should be double action cylinders so that an upwardly directed movement as well as a downwardly directed movement of the cylinder axis 180 and thus of the telescopic rod 190 may be directly proportionally transmitted to the mat-applicator device. A dimensionally true dynamic coupling between the axis of rotation of the cutter cylinder 180 and the vertically slidable mat-applicator device with the component part 172 may be achieved by a suitable selection of cylinder volumes for the two intercommunicating hydraulic cylinders in per se conventional manner. The cylinder-piston unit which determines the vertical position of the mat-applicator device may, for example, consist of a hydraulic pit prop adapted to be charged or loaded on both sides thereof.

A particularly large and extensive securing of the roof in the region of the machine body may be achieved with the aid of the mat-applicator device 200 illustrated in various views in FIGS. 14 to 16 of the accompanying drawings. In contrast with the example of execution diagrammatically represented in FIGS. 8 to 10, wherein the matting strip 109*a* on being drawn off the roll 109 is redirected substantially direct into the applicator device at or near the roof and an approximately triangular area behind the operative cutter cylinder 2 remains uncovered, the arrangement depicted in FIGS. 14 to 16 provides for the matting strip to be initially redirected oppositely to the direction of laying, i.e. in the direction of travel of the machine (arrow P) and then returned into the correct laying direction by a pulley or roller 202 fitted at the leading end of the mat applicator device 200. The directions in which the matting strip 201 extends and advances in the region of the mat applicator device are indicated by the arrows *x,y,* and *z* in FIGS. 14 and 16.

As will be noted from a comparison on the plan views given in FIGS. 2 and 8, the last described arrangement allows the roof to be supported by the laid mat 201 in the immediate vicinity of the precursing cutter cylinder 2 and thus to be immediately secured in this region whereas, owing to the parallel disposition of the axis of the reversing pulley 202 with the cylinder axis the triangular area shown in dot-and-dash lines in FIG. 9 is also fully covered.

The pulley 202 which constitutes the mat-applicator device proper is connected via a leaf spring mechanism 208 with a supporting element 213 secured on the machine body. This supporting element may be constructed as described with references to FIGS. 8 to 13. With a view to preventing malfunction in the mat-laying process and/or damage to the mat-laying device, particularly under heavy loads applied to the mat-applicator device, the example of execution depicted in FIGS. 14 to 16 includes the provision of a special safety cut-out device or switch which is capable of instantaneously stopping the coal cutting machine.

In the illustrated example this safety cut-out device comprises a hydraulic cylinder 212 arranged on an angled supporting arm or bracket 111 extending beneath one of the lateral arms 210 of the leaf spring mechanism 208, with a piston 212*a* which is plunged into the cylinder when subjected to a load applied thereto by the dropping lateral arm 210 of the overloaded spring mechanism 208. This piston-cylinder device is connected with a cut-out switch mechanism not here specifically shown, of any suitable design which is actuated by the descending piston 212*a* at the critical moment to stop the coal cutting machine.

The co-operating described with reference to FIGS. 14 to 16 between a mat-deflector edge which in the illustrated example extends at an angle of substantially 45° relative to the axis of rotation of the cutter cylinder, with a pulley 202 extending substantially parallel with said axis ensures virtually trouble-free direction of the matting strip into the applicator device with the strip unwinding from the storage roll transversely of the direction of travel of the machine, even if the coal cutting machine travels over comparatively irregular floor levels.

I claim:

1. A method of supporting the roof of an underground mine working in a region newly exposed by the passage of a mining machine along an upright face of the working, comprising:

a. storing a supply of flexible mat in a region which is already supported by self-advancing roof supports,
b. moving said supply of flexible mat along the face of the working, with the mining machine,
c. drawing mat from said stored supply in a first direction generally transversely of the direction of passage of the mining machine,
d. redirecting said mat to extend generally parallel to the direction of passage of the mining machine along the newly exposed roof,
e. pressing said extended mat into contact with the roof by advancing and loading the self-advancing roof supports in said direction generally transversely of the direction of passage of the mining machine.

2. A method of supporting the roof of an underground mine working in a region newly exposed by the passage of a mining machine along an upright face of the working comprising:

a. storing a supply of flexible mat and leading off mat from said stored supply,
b. applying the mat to the roof by directing means so that the mat extends along the newly exposed roof,
c. controlling the vertical disposition of the directing means in accordance with the vertical disposition of a cutting element of the mining machine.

3. Apparatus for supporting the roof of an underground mine working in a region newly exposed by the passage of a mining machine along an upright face of the working, comprising:

a. mobile means for storing a supply of flexible mat,
b. means for leading off mat from said supply thereof,
c. directing means for directing the mat to extend along the newly exposed region of roof so that it can be underpined by self-advancing roof support means,
d. means establishing an operative connection between said directing means and a cutting element of the mining machine so that the vertical disposition of the directing means is controlled in accordance with the vertical disposition of said cutting element.

4. Apparatus according to claim 3 wherein the means for establishing the operative connection between the directing means and the cutting element comprises a parallelogram arrangement of pivotally interconnected members, a first member being provided by a body part of the mining machine, a second member by an arm on which the cutting element of the mining machine is supported, a third member by an arm pivotally mounted on said body, and the fourth member by a rigid member extending between the free ends of the second and third members.

5. Apparatus according to claim 4, further comprising a support structure including a vertically movable part, the directing means being mounted on such vertically movable part, and guide means provided on said vertically movable part and slidable on the fourth member of the parallelogram arrangement.

6. Apparatus according to claim 3 wherein the means for establishing the operative connection between the driving means and cutting element includes flexible drive members operatively connected to the directing means and cutting element, and transmission means for effecting the correct operative relation between the directing means and cutting element.

7. Apparatus according to claim 3 wherein there is provided releasable connecting means whereby a readily releasable connection is established between the cutting element and directing means.

8. Apparatus according to claim 3 wherein there is provided means responsive to excessive downward movement of the mat-directing means, and operable to disable the mining machine.

9. Apparatus according to claim 3 wherein the directing means includes a first directing member operable to direct mat to extend in the same direction of travel as the mining machine, and a second directing member operable to direct the mat in the opposite direction to the direct of travel of the mining machine and to apply such mat to the roof.

10. A method according to claim 1 wherein the supply of flexible mat comprises a roll thereof with its axis disposed generally parallel to the direction of passage of the mining machine, and the method comprises unrolling the mat therefrom in said first direction.

11. Apparatus for applying a flexible mat to the roof of an underground mine working in a region newly exposed by the passage of a mining machine along an upright face of the working, the roof being supported by self-advancing roof supports, comprising:

a. mobile means for storing a supply of mat, such means occupying a region which, in use, is remote from the newly exposed roof region, and including a supporting bar member disposed generally parallel to the direction of passage of the mining machine and adapted to receive matting in the form of at least one roll thereof, b. means for leading off mat from said supply in a first direction, and c. directing means for redirecting said mat to extend along the newly exposed roof and including a steering member, a jib member projecting towards the face, and an intermediate mounting arm between the steering member and jib member and extending at right angles to the jib member, the mounting arm and jib member including leaf spring members.

12. Apparatus for applying a flexible mat to the roof of an underground mine working in a region newly exposed by the passage of a mining machine along an upright face of the working, the roof being supported by self-advancing roof supports, comprising:

a. mobile means for sorting a supply of mat, such means occupying a region which, in use, is remote from the newly exposed roof region, and including a supporting bar member disposed generally parallel to the direction of passage of the mining machine and adapted to receive matting in the form of at least one roll thereof, b. means for leading off mat from said supply in a first direction, c. directing means for redirecting said mat to extend along the newly exposed roof, and d. means for resisting rotation of the roll of matting to apply tension to matting withdrawn from the supply.

* * * * *

UNITED STATES PATENT AND TRADEMARK OFFICE

CERTIFICATE OF CORRECTION

PATENT NO. : 4,099,785

DATED : July 11, 1978

INVENTOR(S) : Karl Maria Groetschel

It is certified that error appears in the above-identified patent and that said Letters Patent are hereby corrected as shown below:

In the heading of the patent, under [30] Foreign Application Priority Data, change "2679509" to --2619509--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*